United States Patent [19]

Focke

[11] Patent Number: 4,785,933

[45] Date of Patent: Nov. 22, 1988

[54] POUCH PRODUCED FROM A FLEXIBLE SHEET BLANK

[75] Inventor: Heinz Focke, Verden, Fed. Rep. of Germany

[73] Assignee: Focke & Co., (GmbH & Co.), Verden, Fed. Rep. of Germany

[21] Appl. No.: 64,473

[22] Filed: Jun. 22, 1987

[30] Foreign Application Priority Data

Jun. 28, 1986 [DE] Fed. Rep. of Germany ..... 3621813

[51] Int. Cl.[4] ..... B65D 85/10

[52] U.S. Cl. ..... 206/260

[58] Field of Search ..... 206/260, 632; 383/52, 383/85, 88, 91, 123, 124

[56] References Cited

U.S. PATENT DOCUMENTS 2,161,474 6/1939 Klein ..... 206/260
3,510,053 5/1970 Focke ..... 206/260
3,596,828 8/1971 Foster et al. ..... 206/260
3,696,917 10/1972 Levi ..... 206/260

FOREIGN PATENT DOCUMENTS 1949723 4/1970 Fed. Rep. of Germany .
2934673 3/1981 Fed. Rep. of Germany .

*Primary Examiner*—Willis Little
*Attorney, Agent, or Firm*—Sughrue, Mion, Zinn, Macpeak & Seas

[57] ABSTRACT

In a (roll-up) pouch, a transverse closing seam 20 can be pulled open (peel-seal seam). The closing seam 20 is formed in the region of a closing strip 22 folded round inwards. This is provided, at the ends or lateral edges, with recesses 23, 24 which allow stable sealing in this region and which thus stabilize the closing seam at the ends.

3 Claims, 2 Drawing Sheets

POUCH PRODUCED FROM A FLEXIBLE SHEET BLANK

BACKGROUND OF THE INVENTION

The invention relates to a pouch produced from a flexible sheet blank, especially a roll-up pouch for receiving cut tobacco, with a pouch part which consists of a front wall and a rear wall and which is closed by means of a pull-open closing seam made by a seal (peel-seal seam).

Cut tobacco is mainly packaged in pouches produced from a flexible sheet blank. Roll-up pouches, in which the tobacco is accommodated in a pouch part, are particularly widespread. This pouch part consists of a front wall and a rear wall which are joined together as a result of sealing in the region of side seams. An extraction orifice is closed by means of a closing seam, likewise made by sealing, between the front wall and the rear wall. The rear wall is conventionally equipped with an extension serving as a roll-up flap.

In order to open the pouch part, in this particular type of (roll-up) pouch the closing seam can be pulled open, in particular is designed as a peel-seal seam. This effect is achieved especially because the sheet consists of outer coatings differing from one another in terms of sealing behaviour. So that the different coatings rest against one another in the region of the orifice or the closing seam and can be joined together by means of a pull-open closing seam, a closing strip folded round inwards is formed on the edge of the front wall and rests with its outer coating against the inner coating of the rear wall. A roll-up pouch of this design is also illustrated and described in German Offenlegungsschrift No. 1,949,723 as regards the use of sealable materials which is under consideration here.

A disadvantage of this pouch with a peel-seal closing seam is that side seams of the pouch part do not ensure durable effective sealing at the ends of the pouch part in the region of the closing strip, since the peel-seal effect comes into play even here.

SUMMARY OF THE INVENTION

The object on which the invention is based is to develop further and improve a pouch (roll-up pouch) of the type mentioned in the introduction, in such a way that, in the region of the side seams of the pouch part, permanently durable welding or sealing is guaranteed continuously, that is to say even at the ends of the closing strip.

To achieve this object, the pouch according to the invention is characterized in that an end seal which cannot be pulled open and which is formed as a result of permanent sealing is made at the ends of the closing seam.

In the preferred embodiment of a pouch with a closing strip folded round inwards, according to the invention the latter is provided with a recess at the ends, at least in the region of the closing seam, in such a way that, in the region of the recess, identical coatings of the front wall and rear wall are sealed directly to one another.

Accordingly, the recess guarantees that the closing strip is "cut out" locally in this end region of the closing strip, particularly in the extension of the side seams, so that the inner coatings of the front wall and rear wall of the sheet blank rest directly against one another and can be sealed permanently to one another as a result of their particular nature.

According to a further proposal of the invention, the recess is in the form of the area of a part circle and is open towards the free edges of the sheet blank.

BRIEF DESCRIPTION OF THE DRAWINGS

An exemplary embodiment of the invention is explained in detail below with reference to the drawings. In these.

DETAILED DESCRIPTION OF A PREFERRED EMBODIMENT

Figure 1:
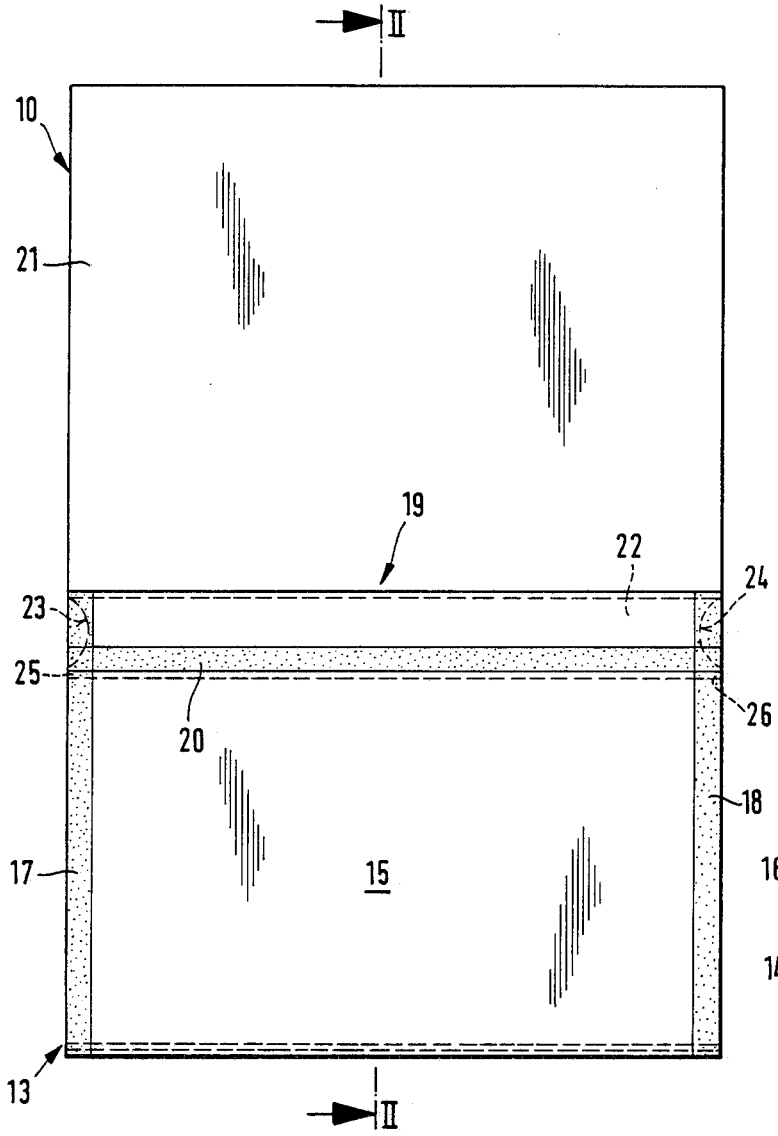
FIG. 1 shows a view of a (roll-up) pouch, with the roll-up flag opened.
Figure 2:
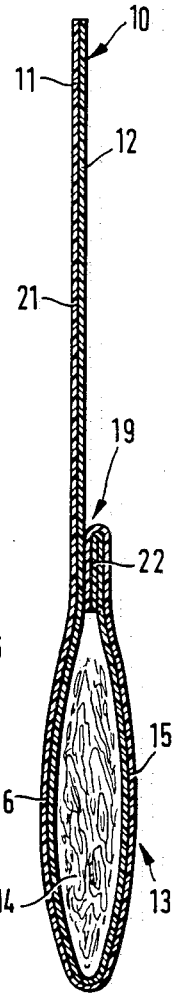
FIG. 2 shows a cross-section through the roll-up pouch according to FIG. 1.

The preferred embodiment of a (roll-up) pouch illustrated consists of a blank 10 formed from at least two layers, namely an outer coating 11 and an inner coating 12. These coatings 11 and 12 can consist of the same material as that described in German Offenlegungsschrift No. 1,949,723 or have at least the same technological behaviour as regards sealability. However, the blank can have further inner layers, especially an inner aluminum layer which is provided with the coatings 11 and 12.

The pouch consists of a pouch part 13 for receiving the pouch content, namely a portion of cut tobacco 14. The pouch part is formed from a front wall 15 and a rear wall 16 which, when a one-piece blank 10 is used, merge into one another. Laterally, the front wall 15 and the rear wall 16 are joined to one another by means of side seams 17 and 18 extending in the longitudinal direction of the blank 10. These connections are extremely stable, since they are made by sealing the inner coatings 12 to one another.

Arranged in the region of a pouch orifice 19 is a transverse closing seam 20 which extends from one side edge to the adjacent side edge. To make a roll-up pouch, the rear wall 16 is equipped with an extension which forms a roll-up flap 21.

The closing seam 20 has special technological properties, in particular can be pulled open (a so-called peel-seal seam). In the present case, this effect is achieved because, at the free top edge of the front wall 15, a closing strip 22 of the blank 10 is folded round inwards against the inner face of the front wall 15. This closing strip 22 rests against the inner face of the rear wall 16 in the region of the pouch orifice 19. Accordingly, different coatings, namely the outer coating of the closing strip 22 and the inner coating of the rear wall 16, come to rest against one another here. Thus, the differing sealing behaviour results, in this region, in a closing seam 20 which allows the closing strip 22 to be detached from the rear wall 16 when the pouch part 13 is opened. In contrast, the connection between the closing strip 22 and the upper region of the front wall 15 is stable because the inner coatings rest against one another.

In a closing seam 20 designed in this way and arranged in the region of a closing strip 22, to fix its lateral ends in the region of the side seams 17, 18, the closing strip 22 is provided at the ends, that is to say in the region of the side seams 17, 18, with recesses 23, 24 which allow the inner face of the front wall 15 to rest directly against the inner face of the rear wall 16 in this region. Accordingly, the inner coatings 12 to be sealed firmly to one another come directly up against one another here. Thus, as a result of the recesses 23, 24, the side seams 17, 18 which are continuous up to the top edge of the front wall 15 can ensure direct sealing of the front wall 15 and rear wal 16 to one another even in the region of the closing strip 22. A highly stable connection is therefore made in this region also, but nevertheless allows the pull-open closing seam 20 to be fully effective, without the possibility that the front wall 15 and rear wall 16 will be detached from one another in the edge regions.

The recesses 23, 24 are specially designed so that the lateral ends of the closing strip 22 are anchored between the front wall 15 and the rear wall 16 by means of the side seams 17 and 18. This means that the recesses 23, 24 do not take up the entire area of the side seams 17, 18 in the region of the closing strip 22, but, particularly at the top and bottom edges of the closing strip 22, leave regions in which the closing strip 22 remains connected to the front wall 15 and rear wall 16 by means of the side seams 17, 18. In the preferred exemplary embodiment, the recesses 23, 24 are in the form of the area of a part circle and are open towards the free side edges. The recesses 23, 24 are arranged at a distance from the free edge of the closing strip 22, so that residuals webs 25, 26 remain cut out and guarantee the above-described anchoring of the closing strip 22.

Figure 3:
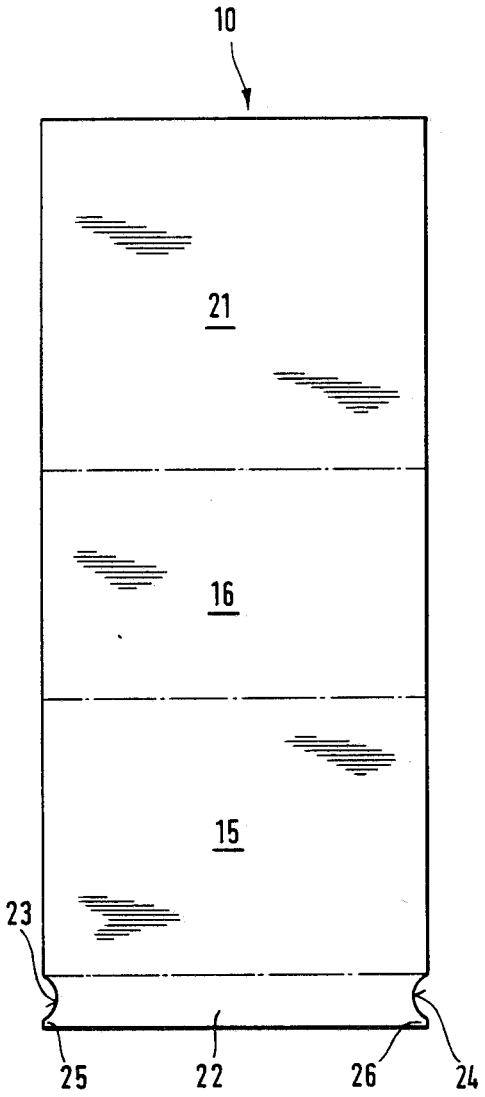
FIG. 3 shows a blank for producing a roll-up pouch according to FIGS. 1 and 2, in the spread-out state.
Figure 4:
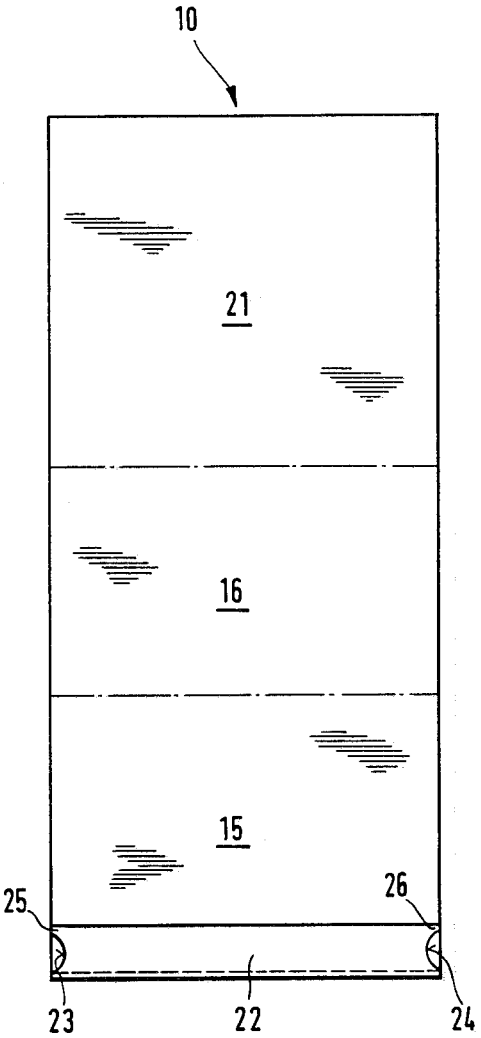
FIG. 4 shows the blank according to FIG. 3 with the closing strip folded round.

As is evident from FIGS. 3 and 4, the recesses 23 are made by being punched out at the predetermined points in the flat spread-out blank 10 which, in particular, is severed from a web of material. The closing strip 22 is then folded round against the inner face or against the inner coating 12 of the blank 10. Thereupon, the pouch part 13 is formed by means of the side seams 17 and 18. The cut tobacco 14 can now be introduced and the closing seam 20 then made.

What is claimed is:

1. Pouch made of a flexible sheet blank, especially a roll-up pouch for receiving cut tobacco, and comprising:

a sheet blank (10) provided with an outer coating (11) and an inner coating (12) of differing coordinated thermal sealability;

a pouch part (13), having a front wall (15) and rear wall (16), for receiving the pouch contents and closed by means of a pull-open, peel-seal closing seam (20);

said closing seam (20) being located in the region of a closing strip (22) formed by a folding over of the sheet blank (10) so that the inner and outer coatings (11, 12) of the sheet blank (10) rest against one another and are joined to one another by the closing seam (20); and recesses (23, 24) at opposite ends of the closing strip (22) and located such that, at said opposite ends, said inner coating on an inner side of said front wall (15) and said inner coating on an inner side of rear wall (16) rest directly against one another and are permanently joined to one another by sealing.

2. Pouch according to claim 1 wherein the recesses (23, 24) are in the form of the area of a part circle and are open towards the opposite ends.

3. Pouch according to claim 1 or 2, characterized in that the recesses (23, 24) have a smaller width than the closing strip (22) and are arranged at a distance from the free edge of the latter, to form residual webs (25, 26) of the closing strip (22) which are permanently sealable by said inner coating between the front wall (15) and rear wall (16).

* * * * *